United States Patent [19]

Lemoine

[11] Patent Number: 4,472,625

[45] Date of Patent: Sep. 18, 1984

[54] SELECTABLE DECIMAL POINT FOR PRINTING DEVICE

[75] Inventor: George J. Lemoine, Monroe, Conn.

[73] Assignee: Pitney Bowes Inc., Stamford, Conn.

[21] Appl. No.: 447,813

[22] Filed: Dec. 8, 1982

[51] Int. Cl.[3] ..... G07G 1/00

[52] U.S. Cl. ..... 235/101

[58] Field of Search ..... 235/101; 101/91; 400/285.2, 148

[56] References Cited

U.S. PATENT DOCUMENTS

| | | | |
|---|---|---|---|
| 2,338,590 | 1/1944 | Komusin | 235/101 |
| 2,829,591 | 4/1956 | Rouan | 101/91 |
| 3,823,666 | 7/1974 | Hanson | 235/101 |

*Primary Examiner*—Michael L. Gellner

*Assistant Examiner*—Brian W. Brown

*Attorney, Agent, or Firm*—Martin D. Wittstein; William D. Soltow, Jr.; Albert W. Schribner

[57] ABSTRACT

A postage metering machine has the capability of printing postage on mail by means of a printing device having a plurality of selectively settable printing wheels. The printing wheels have a plurality of numerical printing members, around their periphery, and there is a plurality of spaced printing members disposed between the wheels from which decimal point shaped printing members can be selectively removed in order to vary the position of the decimal point. The ability to vary the decimal point position, provides a means of accommodating various currency denominations required by various countries of the world.

4 Claims, 4 Drawing Figures

Fig. 3
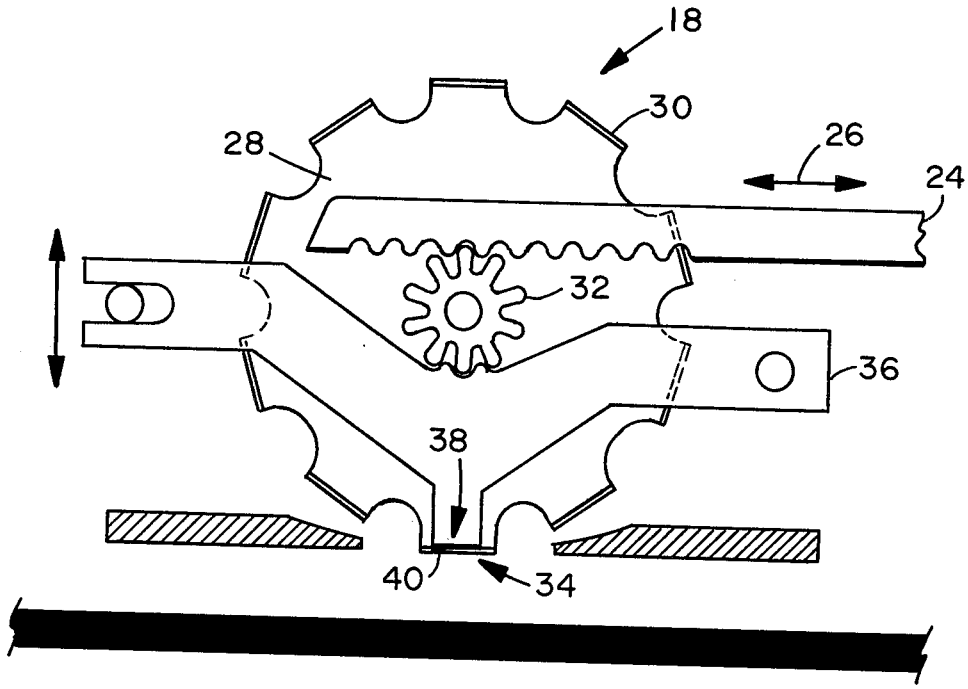
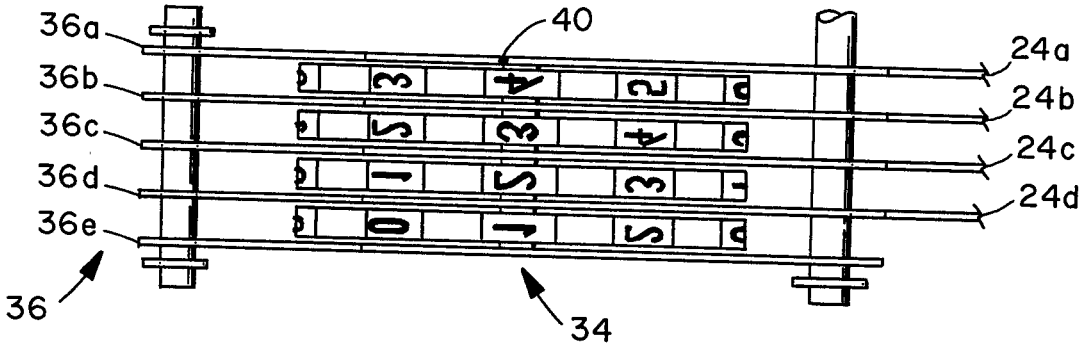
Fig. 4

SELECTABLE DECIMAL POINT FOR PRINTING DEVICE

FIELD OF THE INVENTION

The present invention relates to a printing device for use with a postage meter or franking machine. The printing device has provisions for supplying or eliminating the decimal point used with various currency denominations. There is particular use of the present invention with postage meters or the like, since such machines are used worldwide for printing postage on mail. The printing device is contained within the postage meter and has electromechanical means associated with selecting levers, and a keyboard to change the value of the desired postage. An operator can selectively provide a value from zero to a maximum amount, which is typically the upper limit of the meter's capability, and is dependent upon the postage remaining in the meter's value banks. Regardless of the amount of postage desired, it is well known that a decimal point, printed with currency amounts, identifies the value immediately, and is particularly useful for indicating decimal fractions of whole numbers.

The problem has been within postage meter printing machines to provide a decimal point with a variable fixed position with respect to the various currency denominations of the world. It is difficult to preassemble the complicated, compact printing device, with a predetermined fixed position for the decimal points since the printer has numerous rotatable wheels, spacer members, and connecting drive members which are assembled and packaged in a secure area of the meter intended for inaccessibility by unauthorized personnel. To assemble the print head of such a meter, with 4 or 5 possible variations of position of the decimal point, would necessitate storage of a large number of meters with the further requirement of supplying the decimal point in those desired variations.

This procedure requires a large inventory of meters with the various decimal point positions, thereby creating a massive inventory problem. Therefore, it can be seen that it is advantageous to completely assemble all meters at one location, and then, at the end of the production line, at a convenient assembly stage, to provide the desired decimal point position to agree with currency denominations as required by whatever number of meters are needed by different countries with the varying currency denominations.

The present invention has solved the aforementioned problem, and provides the means to accommodate all possible variations required to print a decimal point, regardless of currency denominations. It is also possible to entirely eliminate the decimal point, for those countries of the world which do not require it.

SUMMARY OF THE INVENTION

A postage metering machine has the capability of printing postage indicia on envelopes or tape by means of a printing device having a plurality of selectively settable printing wheels. The printing wheels are mounted on a common axis, and have means for setting the wheels which have a plurality of numerical printing members arranged around their periphery. The improvement includes provisions of a plurality of selectively removable decimal point shaped printing members disposed between the print wheels. The decimal point shaped members allow the decimal point position in the printed indicia to be varied or eliminated in the printing device according to need.

OBJECTS OF THE INVENTION

It is an object of the present invention to provide a printing device for printing postage from postage metering machines, franking machines or the like having a requirement of placing a decimal point in a particular fixed position. The position being dependent on the currency denomination requirements of various foreign countries.

It is a further object of the present invention to eliminate the decimal point entirely from the printing device after final production, regardless of whether a decimal point was previously provided.

BRIEF DESCRIPTION OF THE DRAWINGS

FIG. 3 represents a side view of the printing head device of the postage metering machine shown in FIG. 2.

FIG. 4 represents a partial bottom view taken from FIG. 3 of the selectively settable printing wheels, selectively removable decimal points, and spacing members which the points are adhered unto.

DESCRIPTION OF THE PREFERRED EMBODIMENT

Figure 1:
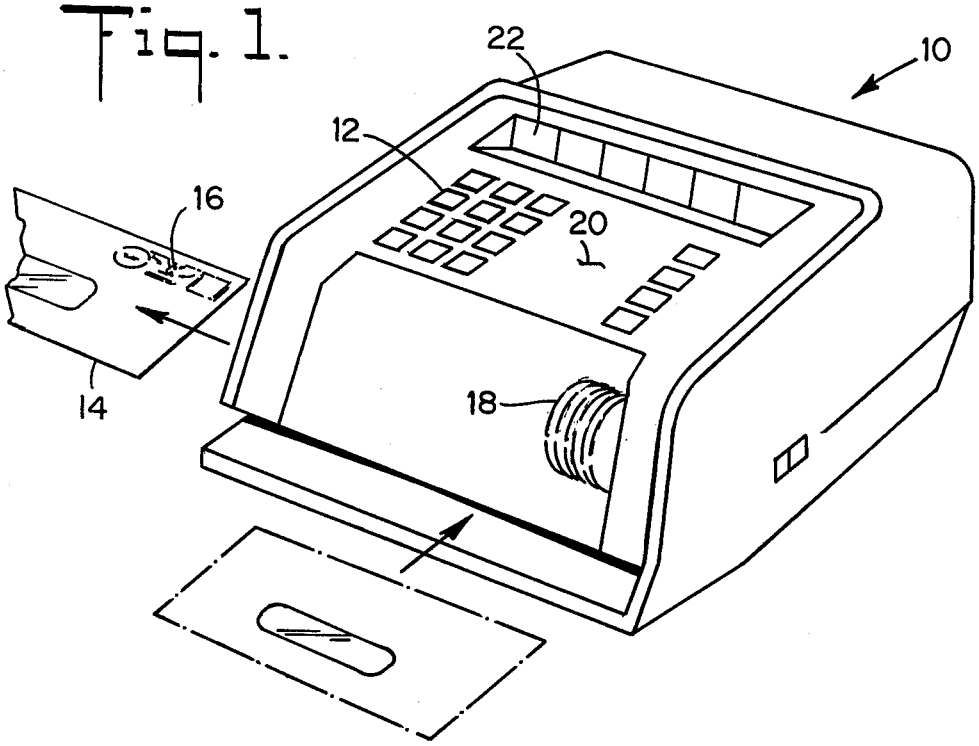
FIG. 1 represents an isometric view of a postage metering machine for producing postage indicia upon an envelope.

Referring to FIG. 1, there is a postage metering machine 10 for printing postage indicia upon letter mail or the like. The meter 10 has the capability through an input keyboard 12 for selecting postage values according to operator requirements and the weight for destination of the article to be mailed. For the purposes of explanation a letter 14 is illustrated in FIG. 1, with a metered postage indicia 16 imprinted in the upper right corner. The meter 10 as illustrated is preferably a meter such as that shown and described in detail in a copending patent application Ser. No. 447,815 to inventors D. Buan and A. Eckert, entitled "Stand Alone Electronic Mailing Machine". The Buan-Eckert application has a detailed description of the construction, and operation of the meter parts pertinent to the present invention to cause operation of the printing device 18 included within the meter 10, such that a print indicia may be registered on a piece of mail pressed against the indicia wheels contained within the print assembly 18.

Figure 2:
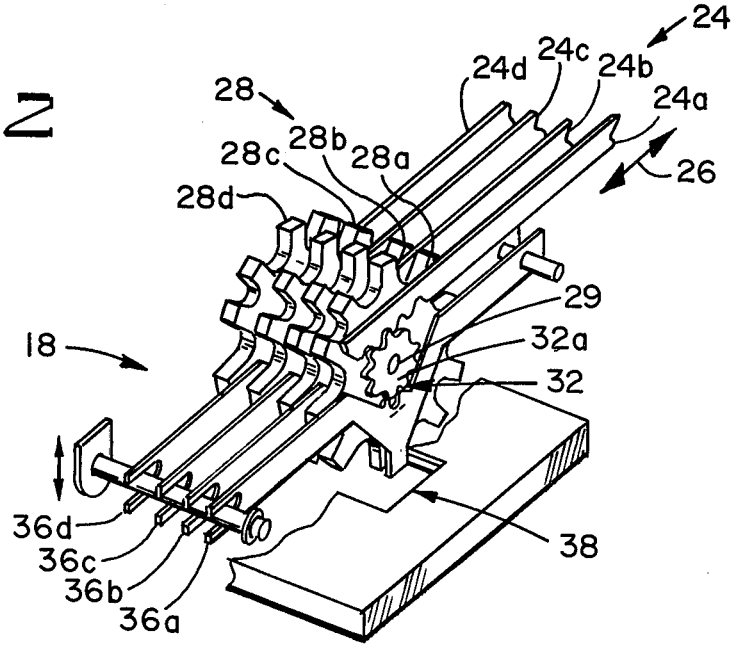
FIG. 2 represents a partial isometric view of the printing device, taken from FIG. 1.

Postage denomination values are selected in the meter 10 by means of the keyboard 12 which is located on the upper surface 20 of the meter 10. The description of the operation of the meter 10 demonstrates how the desired postage input value is displayed on the display window 22, and is further physically obtained at the settable printing assembly 18, for application to the mail. Referring to FIG. 2, there is a set of rack members 24 supported and aligned for reciprocal motion indicated by the arrow 26. The rack members 24 function in conjunction with operative signals derived from the keyboard 12 where each rack member 24 causes rotation of a given print wheel 28 within the printing assembly 18. For each individual rack member 24*a*, 24*b*, 24*c* and 24*d* there is a respective print wheel 28*a*, 28*b*, 28*c* and 28*d*.

Each print wheel 28 is comprised of a number of functional portions such as a complete set of numerical printing members 30 arranged about the periphery of each wheel 28. The numerical printing members 30 range in value from zero to nine. And, corresponding to each set of printing members 30, there is a corresponding gear 32 attached to each print wheel 28 so that a respective gear 32 engages corresponding individual rack members 24. Therefore, rack 24*a* engages gear 32*a*, rack 24*b* engages gear 32*b*, and so forth, so that each print wheel 28 is rotated as required to register and correspond to the correct postage indicated on the display window 22. The corresponding print wheel value set into the printing assembly 18 is aligned in a row 34 (FIGS. 3 and 4) so that it will be printed as a recognizable denomination value, easily readable by post office officials or the like.

There is a set of spacer member brackets 36 corresponding to each gear, which as previously described are attached to the print wheels 28. For wheel 28*a*, the gear 32*a* engages the rack member 24*a*, and spacer member bracket 36*a*. Similarly, print wheel 28*b* is arranged with gear 32*b* to engage spacer member bracket 36*b*. This arrangement is repeated for all banks of the denomination values, so that there is at least one spacer member bracket 36 for each print wheel 28, as described in more detail in said copending application. The spacer member brackets 36 are used to prevent motion of the rack members 18 in the direction of the arrow 26 during the print portion of the meter machine cycle of printing a postage indicia on the subject mail. This is an extremely important function in the print portion of the meter cycle since unauthorized imprints with higher denominations cannot be taken while the spacer member brackets 36 are holding the print wheels 28 in their set respective, intended positions as enabled through the input keyboard 12.

According to the particular currency denomination mandated by the country in the world where the postage metering machine is utilized, it is necessary to provide a decimal point in the franked impression. There is a number of requirements which vary the position of the decimal point mark. Although many currencies have a major and minor unit, authorized practice from postal authorities mandates that a number of alternative methods of depicting postage values in a franked impression be available with or without decimal points. The following table indicates the preference of the zero, minimum and maximum values for some of the countries in the world.

| Franked Impression Decimal Limits | | |
|---|---|---|
| Zero | Min. | Max. |
| 000 | 001 | 9999 |
| 0.00 | 0.01 | 99.99 |
| 0000 | 0010 | 9.999 |
| 00.00 | 00.10 | 99990 |
| 00 | 00 ½ | 999 ½ |

It will be noted that, in some countries of the world, the three wavy line postage symbol ( ) is not acceptable. A zero must be used.

It is evident that it is necessary to provide printing means to accommodate the variations in decimal limits and removal of the decimal point where required, and furthermore the present invention has a practical way of accomplishing the solution to this problem.

Each of the individual spacer member brackets 36 are manufactured with decimal point-shaped printing members 38. The decimal point-shaped printing members 38 are either removably adhered to the spacer member brackets 36 or are formed integrally therewith so as to be either easily removable from the individual spacer member brackets 36 by detaching the decimal point-shaped printing members or by scraping them off of the respective spacer member bracket 36, as the case may be, after final assembly.

When the postage metering machine 10 is completely assembled on the mass production assembly line, those machines having 50 cycle AC capability, and intended for export to a given foreign country may be drawn from the entire lot, and according to the denomination decimal value required given the appropriate predetermined decimal point 40. A manufacturing assembly operator merely has to scrape away those undesired decimal point-shaped printing members 38, on the spacer member brackets 36 as such, in order to remove the other unwanted decimal point members 38 remaining on the other spacer member brackets 31. Or, in the case where a country requires no decimal point to scrape all the decimal point members 36 away from all the spacer member brackets 36.

It is known and understood for the purpose of the present application that the term postage meter refers to the general class of device for the imprinting of a defined unit value for governmental or private carrier delivery of parcels, envelopes or other like application for unit value print. Thus, although the term postage meter is utilized, it is both known and employed in the trade as a general term for devices utilized in conjunction with services other than those exclusive employed by governmental postage and tax services. For example, private, parcel and freight services purchase and employ such meters as a means to provide unit value printing and accounting for individual parcels.

Having described and illustrated an embodiment of the present invention, it will be apparent to those skilled in the art that various modifications and alterations may be made thereto. It is therefore intended that the scope of the present invention shall be limited only as defined in the following claims.

What is claimed is:

1. In a postage metering machine having the capability of printing postage indicia on envelopes or tape by means of a printing device having a plurality of selectively settable printing wheels mounted for rotation on a common axis and including means for setting said printing wheels, each printing wheel having a plurality of numerical printing members arranged around the periphery thereof, the improvement comprising means providing a plurality of selectively removable decimal point or similar shaped printing members disposed between said printing wheels whereby selected decimal point shaped printing members can be removed in order to vary the position or eliminate the printed decimal point in any given amount of postage indicia printed by said printing device.

2. The improvement as set forth in claim 1 wherein said means providing said plurality of selectively removable decimal point shaped printing members comprises a plurality of spacing members disposed between said printing wheels, each of said spacing members having a portion thereof with one of said decimal point shaped printing members mounted thereon in alignment with said numerical printing members so that one or more, or none, of said decimal point shaped printing members will print simultaneously with said numerical printing members during operation of said postage metering machine.

3. The improvement as set forth in claim 2 wherein said decimal point shaped printing members comprise raised bosses formed of a resilient material each of said bosses being removably adhered to said portion of one of said spacing members so that the undesired bosses can readily be scraped off of the corresponding spacing members prior to use of the postage metering machine.

4. The improvement as set forth in claim 2 wherein said decimal point shaped printing members comprise raised bosses formed of a resilient material each of said bosses being formed integrally with said portion of one of said spacing members so that the undesired bosses can readily be scraped off of the corresponding spacing members prior to use of the postage metering machine.

* * * * *